US006231392B1

(12) United States Patent
van Woensel

(10) Patent No.: US 6,231,392 B1
(45) **Date of Patent: *May 15, 2001**

(54) CABLE INTERCONNECTION

(75) Inventor: Johannes Maria Blasius van Woensel, Rosmalen (NL)

(73) Assignee: Berg Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/041,817

(22) Filed: Mar. 12, 1998

Related U.S. Application Data

(63) Continuation-in-part of application No. 08/941,824, filed on Oct. 1, 1997, now abandoned.

(60) Provisional application No. 60/076,064, filed on Feb. 26, 1998.

(51) Int. Cl.[7] ..... H01R 9/03

(52) U.S. Cl. ..... 439/610; 439/701; 439/353; 439/470

(58) Field of Search ..... 439/701, 350–357, 439/358, 372, 607, 610, 470

(56) References Cited

U.S. PATENT DOCUMENTS

| | | | |
|---|---|---|---|
| 4,337,989 | 7/1982 | Asick et al. . | |
| 4,449,778 | 5/1984 | Lane . | |
| 4,460,230 | 7/1984 | McKee et al. . | |
| 4,611,878 | 9/1986 | Hoolhorst et al. . | |
| 4,641,906 | 2/1987 | Olsson . | |
| 4,711,511 | 12/1987 | Noorily | 439/347 |
| 4,744,769 | 5/1988 | Grabbe et al. | 439/284 |
| 4,781,623 | 11/1988 | Philippson et al. | 439/610 |
| 4,842,549 | 6/1989 | Asick et al. | 439/464 |
| 5,108,313 | 4/1992 | Adams | 439/610 |
| 5,112,243 | 5/1992 | Chow et al. | 439/352 |
| 5,120,255 | 6/1992 | Kouda et al. | 439/489 |
| 5,178,556 | 1/1993 | Chen | 439/357 |
| 5,342,215 | 8/1994 | Silbernagel et al. | 439/357 |
| 5,368,505 | 11/1994 | Hoolhorst et al. . | |
| 5,372,513 | 12/1994 | Rodrigues et al. | 439/98 |
| 5,417,590 | 5/1995 | Dechelette et al. | 439/607 |
| 5,419,721 | 5/1995 | Lignelet . | |
| 5,536,183 * | 7/1996 | Brandolf | 439/470 |
| 5,611,708 | 3/1997 | Mizunuma et al. . | |
| 5,613,882 | 3/1997 | Hnatuck et al. | 439/686 |
| 5,620,333 | 4/1997 | Boyle | 439/471 |
| 5,716,228 | 2/1998 | Chen | 439/358 |

* cited by examiner

*Primary Examiner*—Khiem Nguyen
(74) *Attorney, Agent, or Firm*—Brian J. Hamilla; M. Richard Page; Steven M. Reiss

(57) ABSTRACT

A cable connector having improved strain relief and cable retention qualities disclosed. A separate strain relief member includes a ferrule or anvil. This member is placed on a cable. The connector is then assembled and the shields are then attached to the connector parts, including the strain relief member. Latches are provided on a connector that mates with the cable connector. The latches engage the strain relief directly. In one embodiment, the latches engage lugs formed on the strain relief member. In another embodiment, the latches have a plurality of protrusions that engage openings in a facing side wall of the cable connector to aid in maintaining the connectors in mated condition, under forces imparted by the cable. The latches can be removed by inserting latch parts or tools into removal openings in side walls or at the top of the connector on which the latch is mounted. Alternatively, latches are mounted to the cable connector to engage latching elements on the mating connector. A mating connector housing is arranged to accommodate latches mounted thereon on the cable connector.

67 Claims, 18 Drawing Sheets

CABLE INTERCONNECTION

RELATED APPLICATIONS

This application is a continuation-in-part of application Ser. No. 08/941 824, filed Oct. 1, 1997 now abandoned. This application is based on provisional application Ser. No.60/076,064 filed Feb. 26, 1998 and entitled Cable Interconnection.

BACKGROUND OF THE INVENTION

1. Field of the Invention

This invention relates to electrical connectors and more specifically to cable connectors and cable interconnections, and especially to such cable connectors that are shielded.

2. Brief Description of Prior Developments

Cable connectors have been developed that employ shielding to maintain signal integrity during passage of high speed electrical signals. Such developments characteristically include strain relief mechanisms for providing strong attachment to the cable so that individual conductors remain secured to the terminals within the connector.

In addition, latching systems have been proposed for securing cable connectors to mating connectors, especially connectors that are mounted on the circuit boards or equipment with which the cable is to be associated. One such shielded cable connector with an associated latching arrangement is shown in International Application Serial No. PCT/US97/10063, the disclosure which is hereby incorporated by reference. That application is owned by the assignee of this present application. While the shielded connectors and latching systems disclosed in the above noted application provide improved shielding and latching characteristics, there is a desire to improve these connectors and make them more space efficient.

SUMMARY OF THE INVENTION

In order to improve the attachment of a shielded connector onto a cable, an improved means and method for providing strain relief was developed. A strain relief member is placed on the cable prior to attachment of other parts of the connector to the cable. A terminal block is secured on the conductors of the cable, the shielding sheath of the cable is associated with a ferrule of the strain relief member, and the shielding member is placed around the terminal block and in mounting relationship with the strain relief member. Parts of the shield member may be associated with the strain relief member. Thereafter a clamp is applied to clamp the shielding sheath and preferably an outer insulating cover of the cable on the strain relief ferrule.

A latch member is provided on a connector with which the cable connector is to be mated. The latch may engage portions of the strain relief member or other portions of the cable connector. Structure is provided for removably mounting latching members on a connector housing using simple tools or latch parts for demounting the latch.

DETAILED DESCRIPTION OF THE PREFERRED EMBODIMENTS

Figure 1:
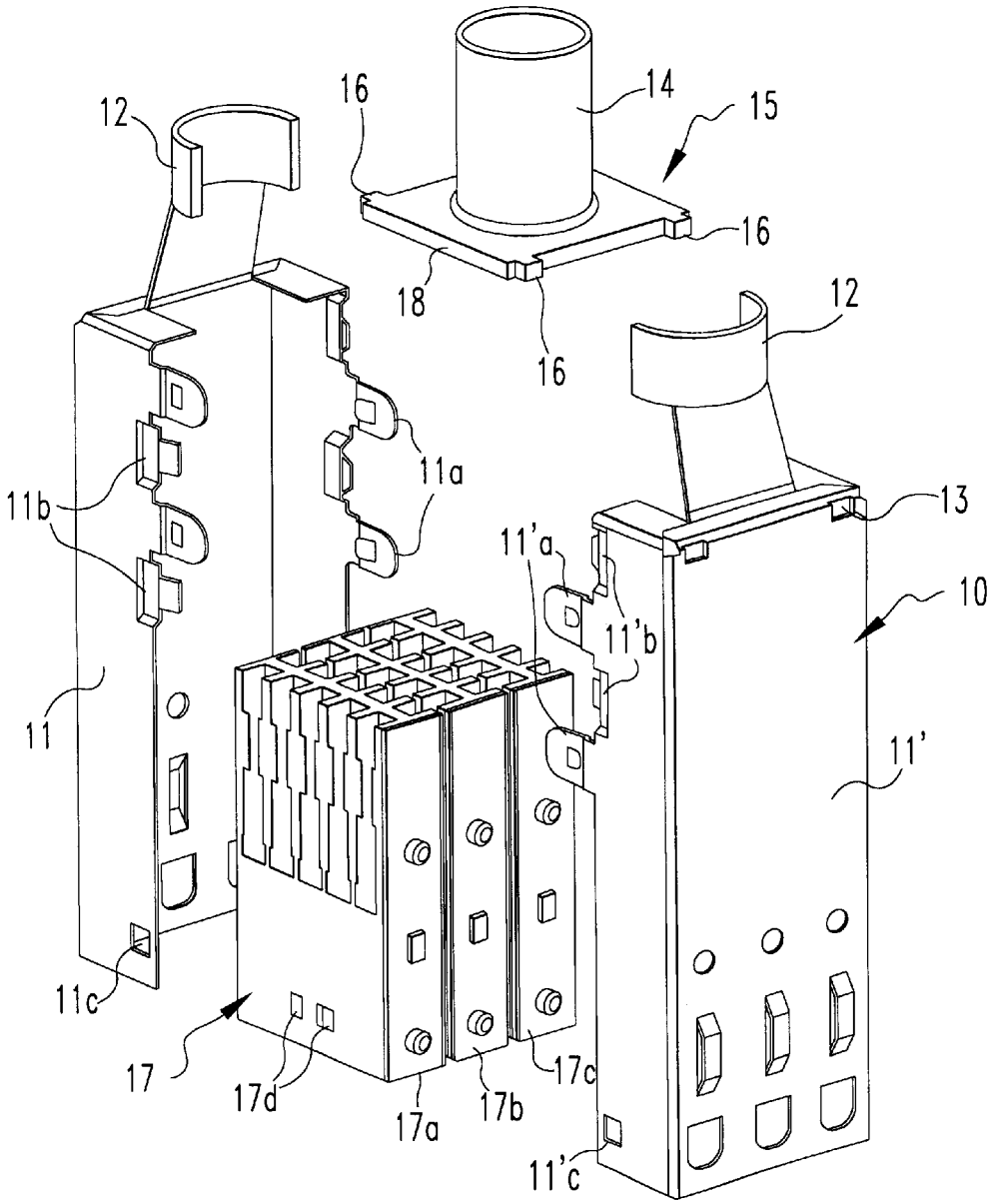
FIG. 1 is an exploded isometric view of a shielded cable connector according to the invention.

FIG. 1 shows generally the principal components of a cable connector 10 in accordance with the invention. The connector 10 includes mating shields 11 and 11' that intermate with each other and are held together by tabs 11*a* and 11*a'*, that interfit and lock with locking portions 11*b* and 11*b'*. In addition, the shields 11 and 11' can include openings 11*c* and 11*c'* that are adapted to receive the latching protrusions 17*d* disposed on opposed outer surfaces of the terminal block 17. Each of the shields 11 and 11' includes a cable engaging portion 12 and a pair of opposed openings 13 disposed along an upper edge.

Each connector 10 includes a strain relief member 15 that comprises a plate or wall member 18 having a central opening surrounded by a ferrule 14. The plate 18 includes a plurality of mounting lugs 16 that are adapted to be received in the openings 13 of the shields.

The connector 10 also includes a terminal mounting block 17 that preferably is formed by a plurality of like modules 17*a*, 17*b* and 17*c* that are snapped or otherwise held together to form the block 17. The modules 17*a, b, c* are is formed of a suitable dielectric material and each receives a plurality of contact terminals, for example, receptacle terminals, to which individual conductors of a cable are associated.

Figure 1A:
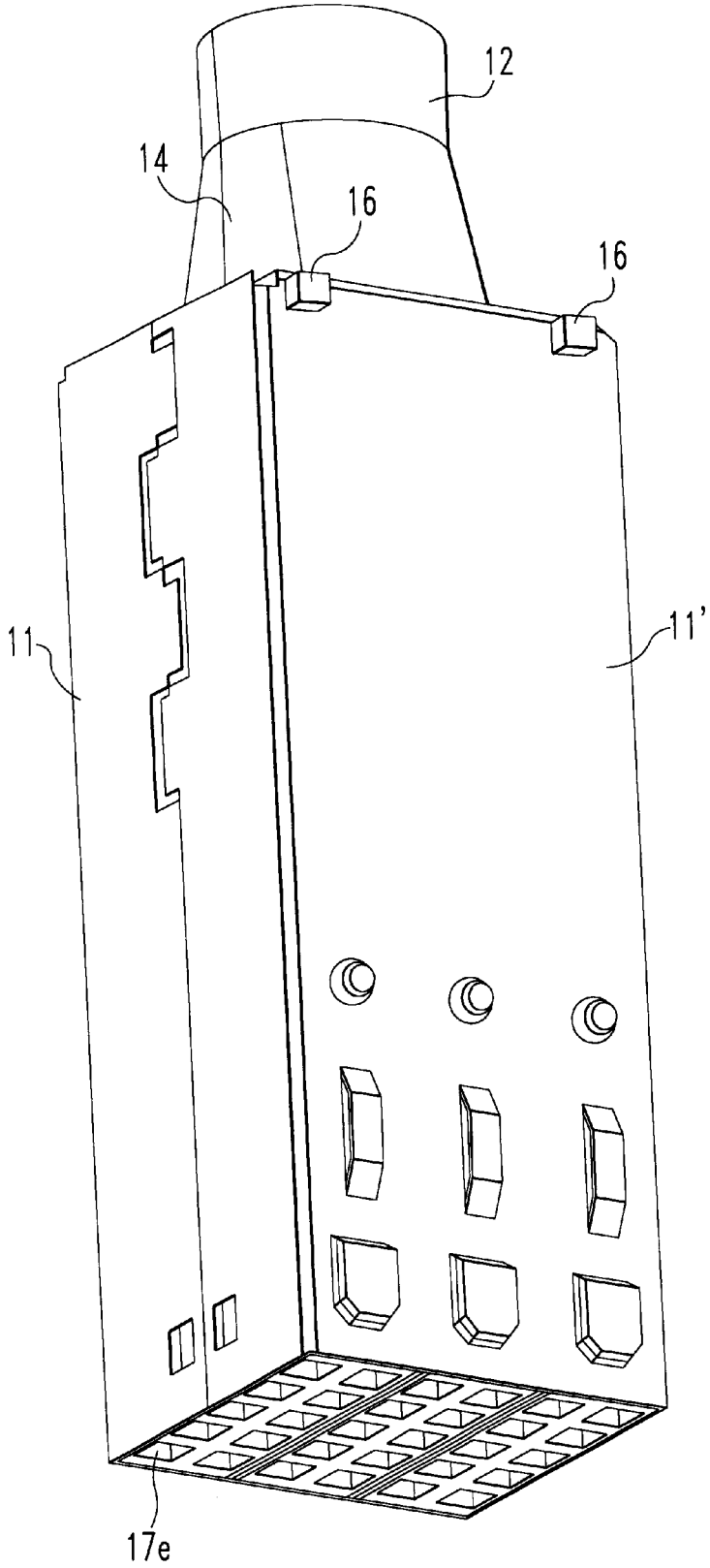
FIG. 1*a* is an isometric view of the cable connector shown in FIG. 1, in assembled condition.

Referring to FIG. 1*a*, when the shields 11, 11' are secured about the terminal block 17, the strain relief member 15 is held in place by the shields, by reason of the interfit of tabs 11*a*, 11*a*' with locking portions 11*b*, 11*b*' and lugs 16 extending through the openings 13. In addition, the cable engaging members 12, preferably in the form of semi-circular members, encircle the ferrule 14. As shown in FIG. 1*a*, the terminal block 17 forms a plurality of openings 17*e*, for receiving terminals, such as pins, from a mating header.

Figure 2:
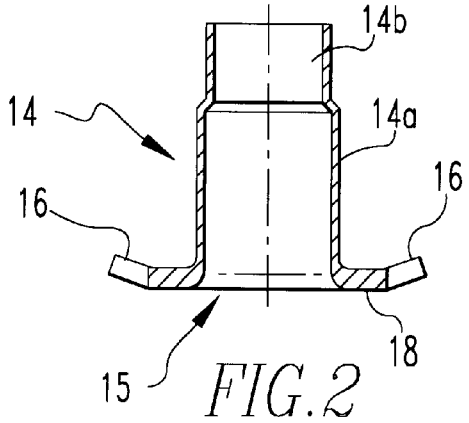
FIG. 2 is a side cross section of a preferred form of a strain relief member.

FIG. 2 illustrates in greater detail a preferred form of strain relief member 15. The member 15 includes a plate or wall member 18 having an opening for receiving a cable. Disposed about the generally centrally positioned opening is a ferrule 14 that includes a first section 14*a* and a reduced diameter section 14*b*. The plate 18 includes lugs 16 at each corner. The lugs 16 are preferably canted upwardly.

Figure 3:
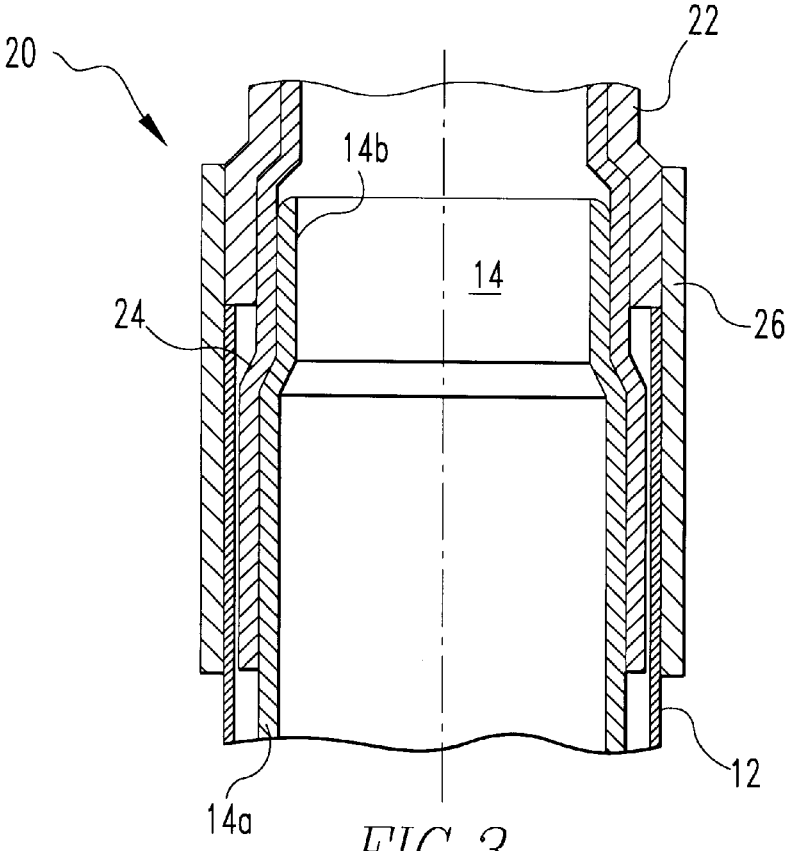
FIG. 3 is a fragmentary cross sectional view of a preferred form of attachment of a cable to the strain relief member shown in FIG. 2.

FIG. 3 shows a cable 20 mounted on the strain relief member 15. For drawing simplicity, the group of mutually insulated conductors or wires within the cable is not shown. As shown, the outer insulative layer 22 of the cable has been stripped back to reveal the conductive shielding sheath 24, usually in the form of a wire braid. The strain relief member has been applied to the cable in a manner such that the ferrule 14 receives the braided sheath in an encircling relationship to sections 14*a* and 14*b*. In addition, a portion of the insulative cover 22 is received over the reduced diameter section 14*b*. Cable engaging portions 12 of the shields are disposed over the ferrule 14 and serve as a stop against insulative cover 22. A clamping member in the form of a crimp ring 26 is disposed over the assembly of the ferrule, the cable and the shield parts 12. When the crimp ring 26 is compressed, the clamping force exerted by the ring clamps the shielding sheath 24, the shield parts 12, and the outer insulative cover 22 against the ferrule 14, which acts as an anvil. As can be seen in FIG. 3, the reduced diameter portion 14*b* is provided to allow for the presence of the portion of the insulative cover 22 that is captured beneath the crimp ring 26.

Figure 4:
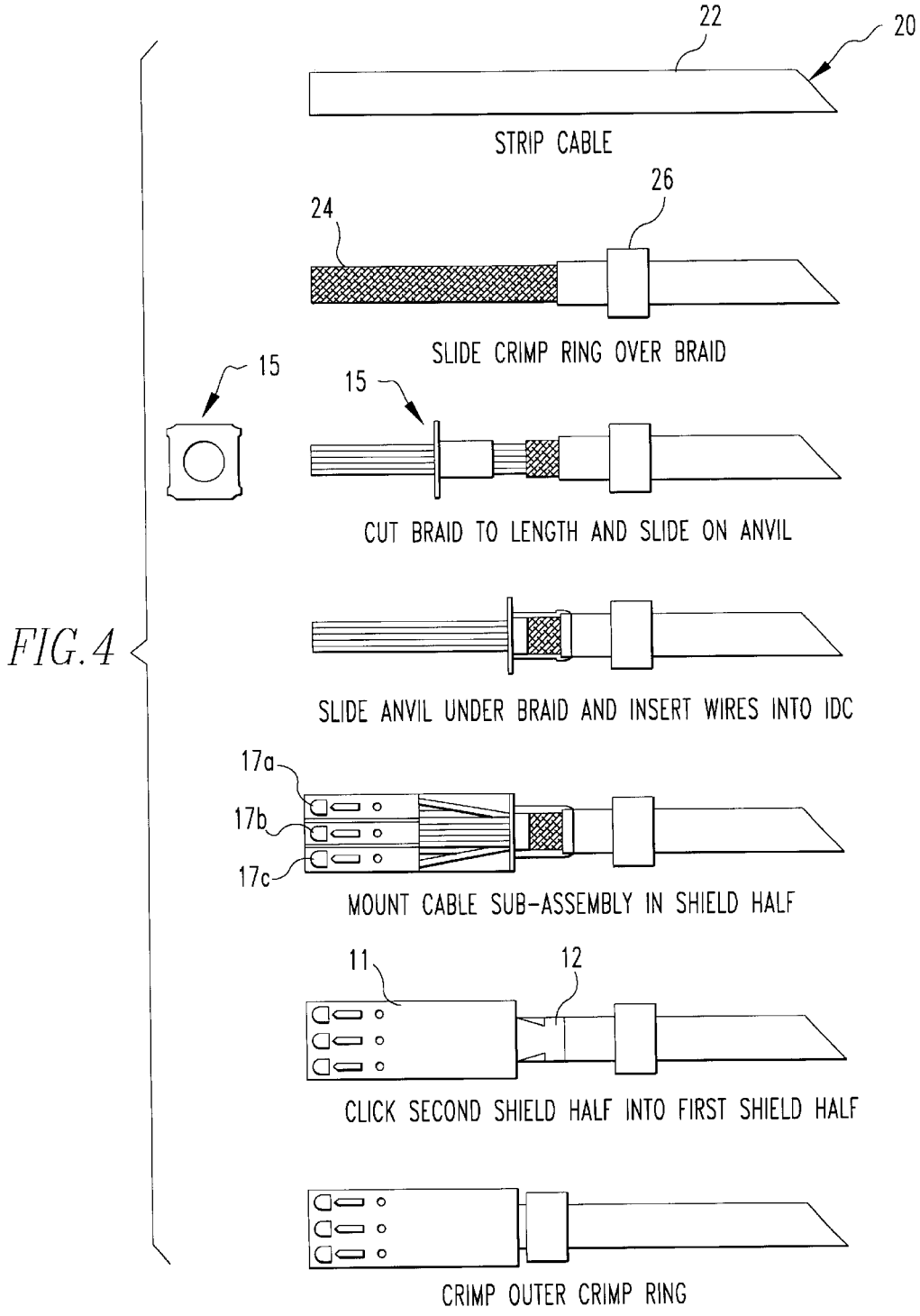
FIG. 4 illustrates a method of assembling the cable connector shown in FIG. 1.

FIG. 4 illustrates in sequential steps the process for attaching a connector onto a cable 20. In a first step, the cable is prepared by stripping a portion of the outer insulative cover or sheath 22 to reveal the braided sheath 24. Thereafter, the crimp ring 26 is slid over the stripped portion of the cable. Thereafter, the braid is cut back to an appropriate length and the strain relief member 15 is slid onto the cable, with the ferrule 14 disposed beneath the braid and preferably a portion of the outer cover 20. Then each of the individual modules 17*a*, 17*b* and 17*c* is associated with the appropriate conductors of the cable. After the conductors are fixed to the terminals, the modules 17*a*, 17*b* and 17*c* are snapped or otherwise secured together to form a terminal block. When the modules are secured together, the two halves of the shields 11 and 11' are snapped in place over the terminal block 17. In a final step, the crimp ring 26 is slid over the ferrule 14 of the strain relief member 15 and is then subjected to a crimping operation. The crimp ring 26 exerts an inward force to clamp the conductive sheath of the cable, the outer insulative layer of the cover and the cable engaging portions of each shield part against the ferrule 14, thereby securing the connector onto the cable.

Figure 5:
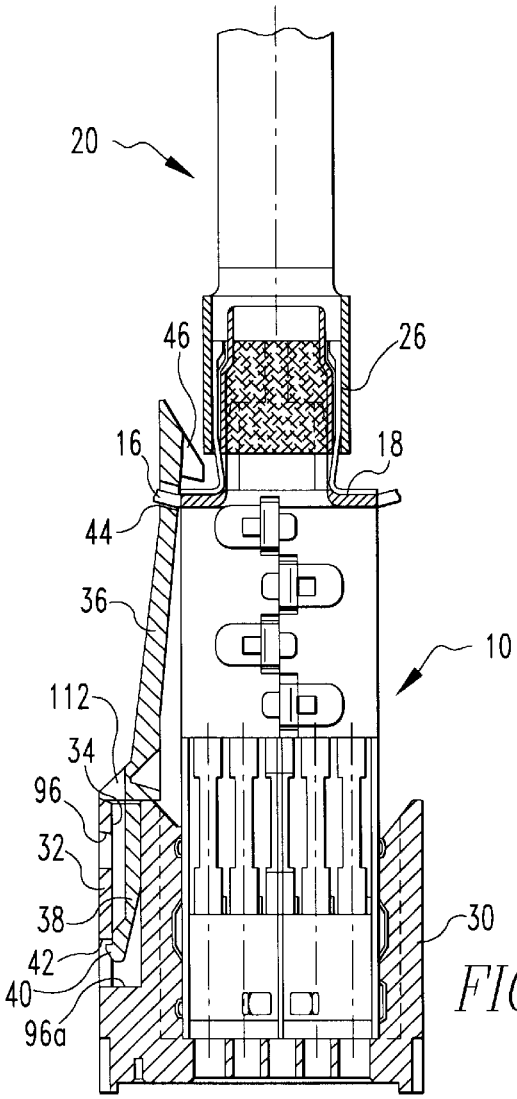
FIG. 5 is a partial cross sectional view showing a cable connector latched into a mating header connector according to one embodiment of the invention.

Referring to FIG. 5, a cable connector 10 is shown attached to cable 20 in the manner previously described. The cable connector 10 is received in a mating header connector 30. The header connector 30 includes an associated pin field formed of an array of pins (not shown) that mate with terminals in the terminal blocks 17. FIG. 5 further illustrates a latch for latching the cable connector 10 to the header 30. One side wall 32 of the header 30 includes an opening or passageway 34 for receiving the mounting legs 38 of a latch 36, shown further in FIGS. 6*a* and 6*b*. The leg 38 includes a locking latch 40 that resiliently engages with the latching surface or detent 42 formed in side wall 38 of the header. The upper end of the latch 36 includes two opposed openings 44 for receiving the canted lugs 16 of the strain relief member 15. To provide additional locking capabilities, a latch hook 46 is carried on the side of the latch 36 adjacent the connector 10. The latch member 46 is shaped and positioned to interact with the base 18 of the strain relief member 15, to provide additional latching. Canting the lugs 16 as shown enhances retention of the lugs in openings 44 and overcomes the effects of tolerance build-up between the latch and cable connector.

Figure 7:
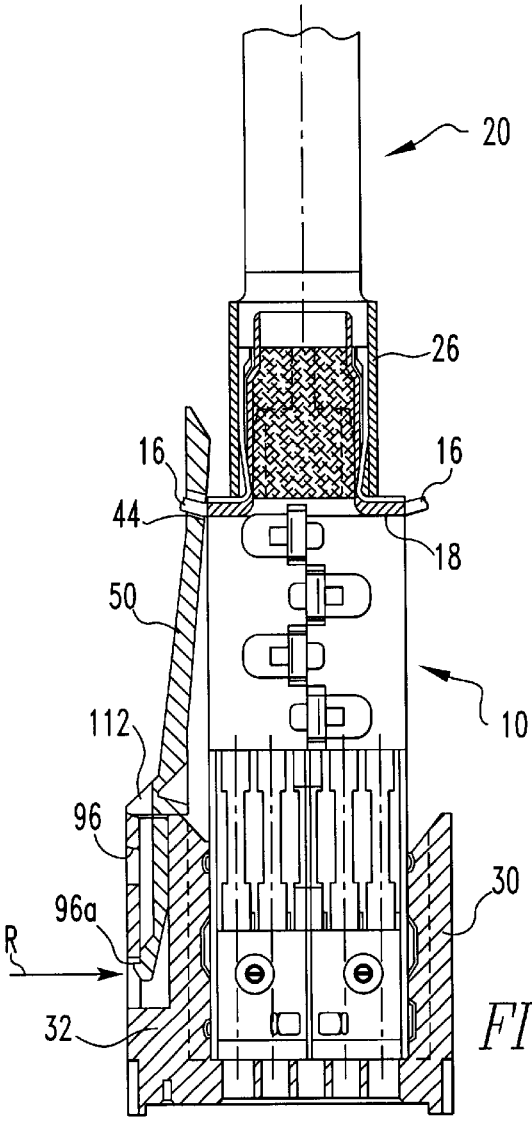
FIG. 7 shows another embodiment of cable to header interconnection.
Figure 17:
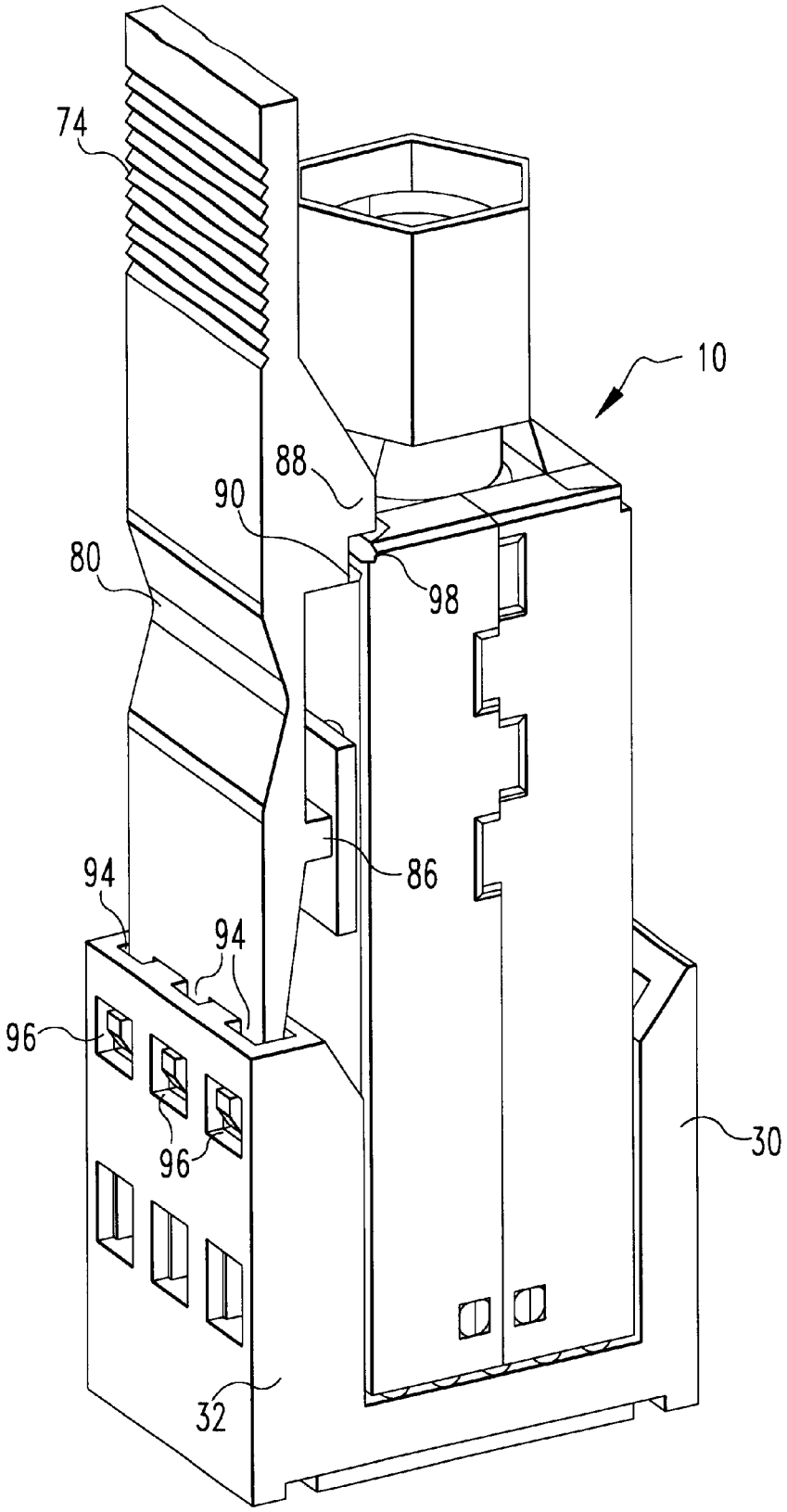
FIG. 17 is an isometric view of a cable interconnection using the latching arrangement illustrated in FIGS. 15 and 16.

The side wall 32 of header 30 also includes two rows of lateral apertures 96 and 96a spaced vertically from each other (FIGS. 5, 7 and 17). The aperture 96*a* forms along its top edge the previously mentioned latching surface 42. The apertures 96 and 96*a* are arranged along a vertical line and extend to opening 34. The apertures 96*a* are shaped and sized form release spaces to receive the distal ends of the mounting legs 38 when inserted in the direction of arrow R (FIG. 7). In this manner, a spare latch member 36, 50 or 60 can be used to push the locking latch 40 away from latch surface 42, to release the latch member and allow its removal from the header 30, for example, if the latch is broken. Thus, no special tool is needed for latch removal.

Alternatively, latch removal may be effected from the top of header 30 by inserting an elongate tool (not shown) through slots 112 (FIGS. 5, 7 and 10), that are axially aligned with the distal ends of openings 34 in the top or an upper surface of side wall 32. The tool is pushed a sufficient distance into opening 34 along a release space formed between side walls of opening 34 and legs 38 to move the locking latch 40 away from the latch surface 42 to release the latch member.

As is later explained, the upper row of openings 96 can receive the projection 78 of the connector mounted latch 70 illustrated in FIGS. 15–20. Thus, the header 30 with the provision of a plurality of apertures 96 and 96*a*, can be simultaneously used in systems having either header mounted latching or connector mounted latching. This reduces tooling costs by providing these alternative capabilities in the same header part.

It should be noted that in this embodiment, the crimp ring 26 is spaced from the base plate 18 to provide clearance for the latch hook 46.

The housing of the header 30 may be formed of a dielectric material or of a suitable conductive material, depending upon shielding requirements.

Figure 6A:
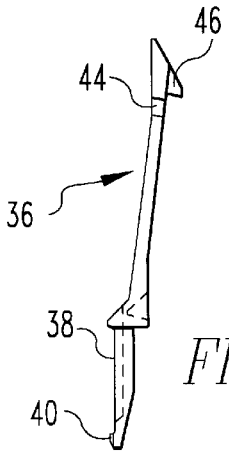
FIGS. 6*a* and 6*b* show, respectively, side and frontal elevations of the latch member shown in FIG. 5.
Figure 6B:
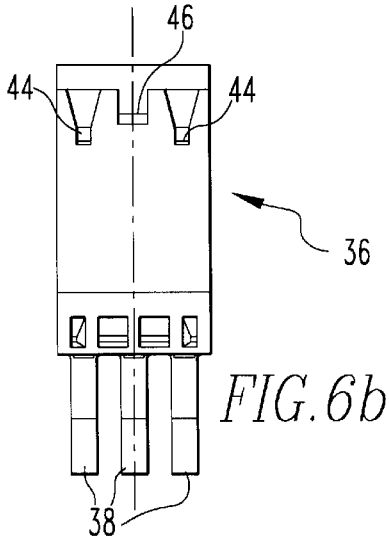

Referring to FIGS. 6*a* and 6*b*, the latch member 36 includes a plurality of mounting legs 38, each of which has a locking latch 40, as previously described. At the opposite end, the latch 36 includes the openings 44 for receiving lugs 16 and the latching hook 46. The latch 36 is preferably formed by molding a suitable polymeric material.

In operation, as the cable connector 10 is inserted into header 30, the latching hook 46 engages the exterior shields 11 of the connector, thereby deflecting the latch generally to the left, as viewed in FIG. 5. As the connector 10 is near its fully mated position, the latch hook passes beyond the back edge of the shield member, thereby allowing the latch to resile toward the right, and thereby allowing the lugs 16 to enter into the openings 44, to retain connector 10 on header 30. To remove the connector 10 from the header, the upper end of the latch is moved to the left so that the latch hook 46 is clear of the shield member and the lugs 16 are no longer positioned in the openings 44.

Figure 8A:
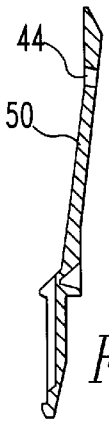
FIGS. 8*a* and 8*b* show respectively a side cross sectional view and a front elevational view of the latch used in the FIG. 7 embodiment.
Figure 8B:
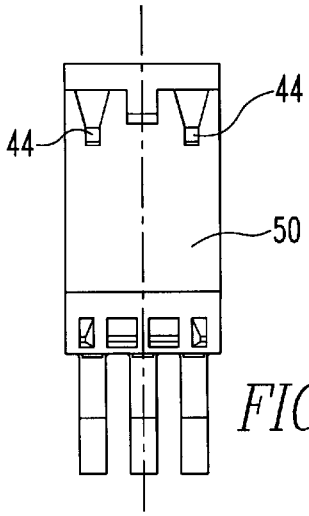

FIG. 7 illustrates a somewhat modified form of the strain relief and latching arrangement illustrated in FIG. 5. In this embodiment, the crimp ring 26 is made longer so that its bottom edge can engage the plate 18 whereby the base plate 18 functions as a positioning stop for the crimp ring. In this embodiment, latch 50 is secured in a side wall 32 of the header 30 in the same manner as discussed with respect to latch 36. The abutment of the longer crimp ring against base plate 18 leaves less space for placement of the hook 46 shown in FIG. 5. Consequently, the upper end of the latch 50 does not carry any latching hook. Rather, retention of the connector 10 on the housing 30 is effected only by the lugs 16 entering the openings 44 of the latch member (see FIGS. 8*a* and 8*b*).

Figure 9:
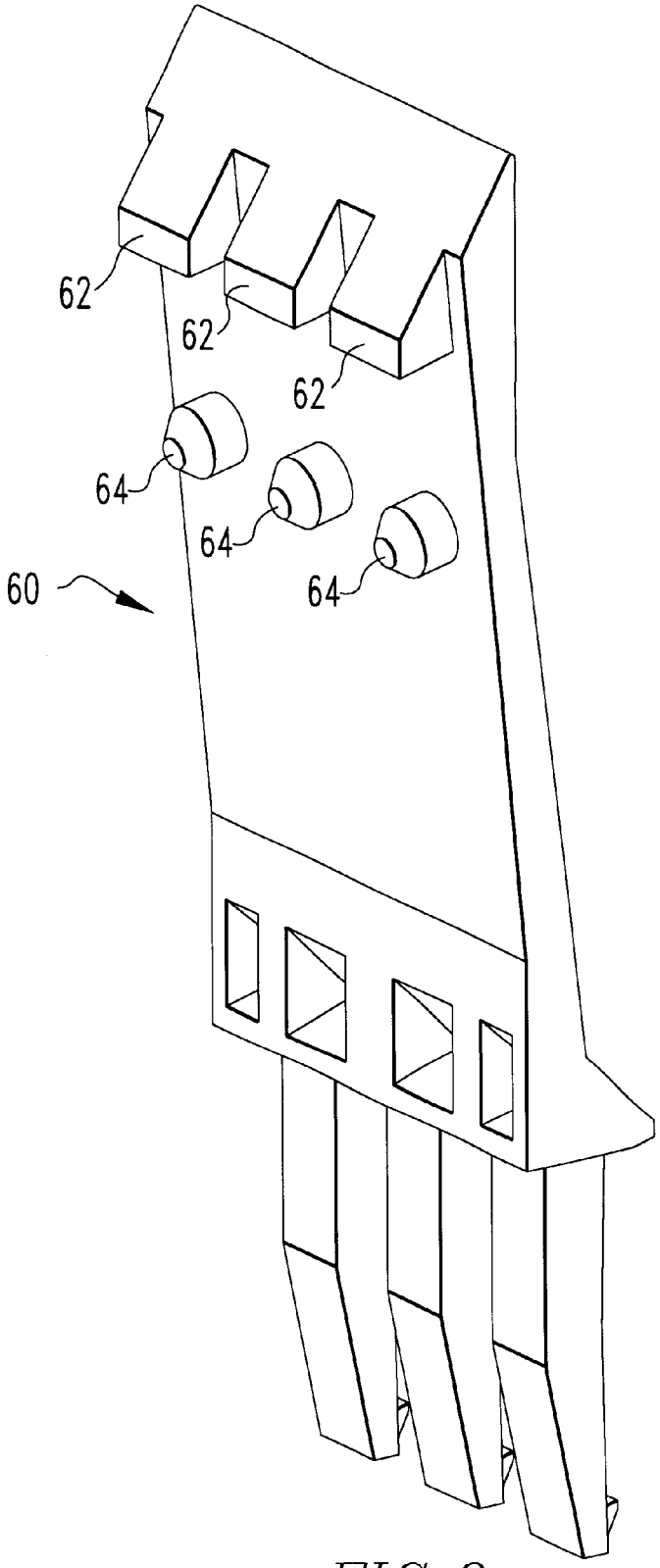
FIG. 9 illustrates another embodiment of latch for latching a cable connector to a header.
Figure 10:
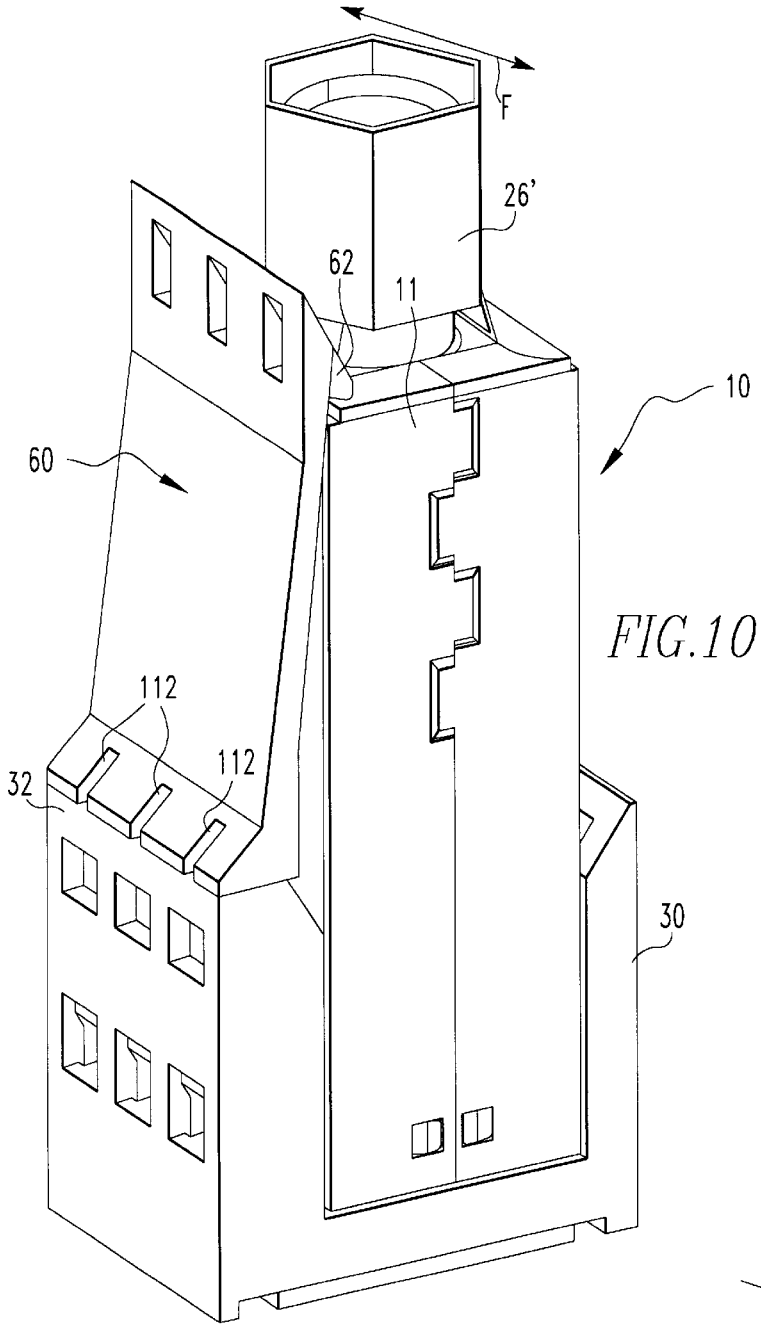
FIG. 10 shows a cable interconnection utilizing the latch shown in FIG. 9.
Figure 10A:
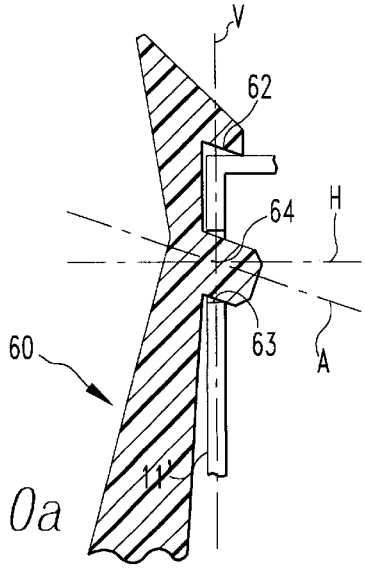
FIG. 10*a* is a fragmentary cross-sectional view showing the latch member of FIG. 9 in operative position.
Figure 11:
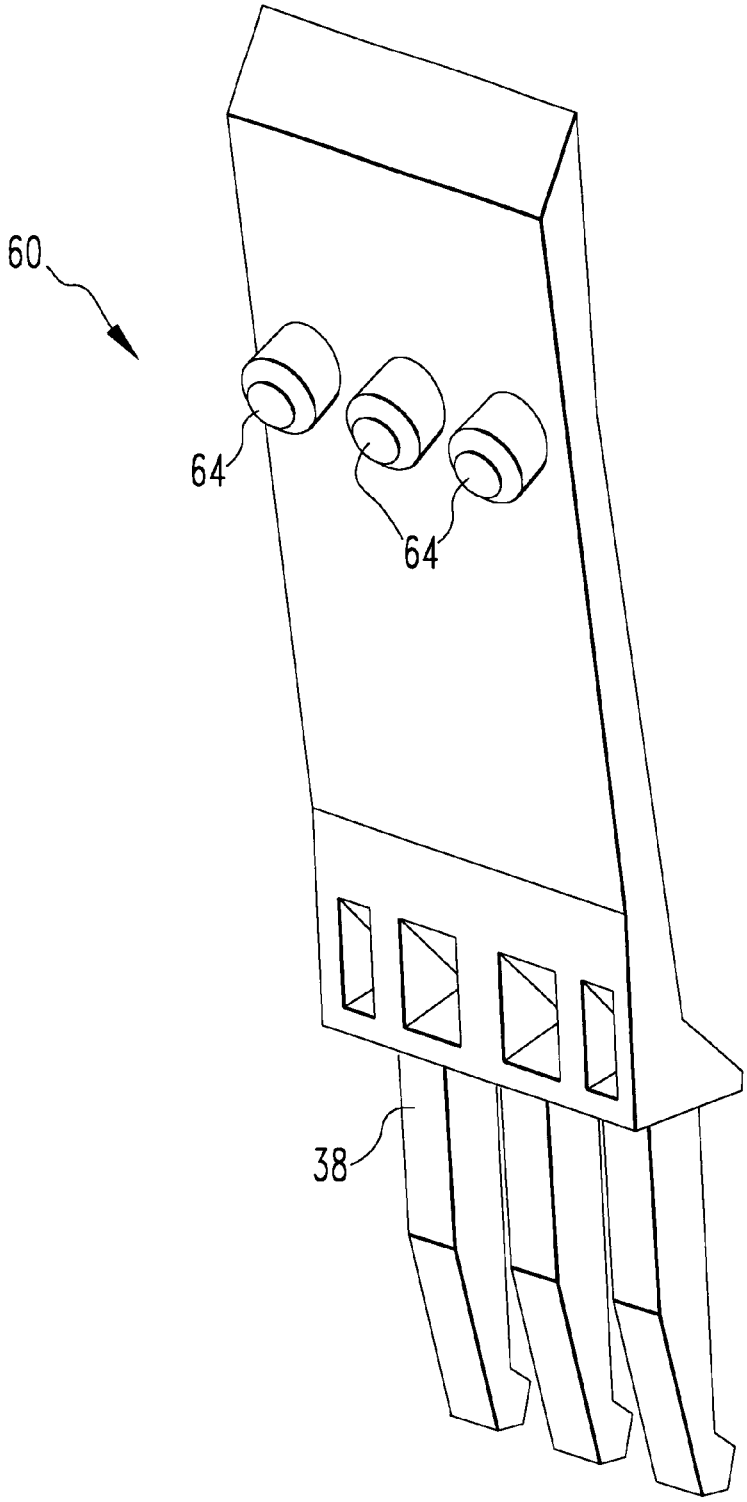
FIG. 11 is a front isometric view of a modification of the latch member of FIG. 9.

Referring to FIG. 9, another embodiment of latch member is shown. In this embodiment, the latch member 60 includes a plurality of latch fingers 62 and a plurality of latching projections 64. Referring to FIGS. 10, 10*a* and 11–14, the latch member 60 is secured onto wall 32 of the header 30 in the same manner as previously described with respect to the latches shown in FIGS. 5 and 7. In the embodiment of FIGS. 9, 10 and 10*a*, the latch fingers 62 latch behind the back edge of the shield members of the connector 10. The embodiment of FIGS. 11–14 differs from that of FIGS. 9–10*a* by the elimination of latch fingers 62. This arrangement allows overall size reduction of the cable connector and is used when the cable and associated strain relief structure extend to the side surfaces of the shields leaving little or no space for fingers 62. Alternatively, centrally located latch fingers may be deleted, leaving only fingers adjacent the edges of latch members 60. In these embodiments, the projections 64 comprise the primary means for securing the cable connection 10 to header 30. The projections 64 enter matching openings 63 in the adjacent surface of the shield 11 for additionally securing the cable connector 10 into the header 30. Thus, in this version, there are no openings for receiving lugs from the strain relief member as in previous embodiments. This arrangement provides for improved fixing of the connector 10 in the header 30 under the influence of the force of the cable acting on the connector. Usually, the cable exerts a lateral force in either direction of arrow F (FIG. 10), tending to rotate or pull the cable connector away from the header. In the embodiments of FIGS. 5 and 7, the openings 44 and lugs 16 must be sized and located under very close tolerances to effectively counter such rotation. However, in the FIGS. 9–14 embodiments, the generally cylindrical projections 64 do not require such high tolerance placement to resist such rotation of the connector. A factor that influences the improved retention of this embodiment is explained in FIG. 10*a*. Preferably, the longitudinal axis A of each projection 64 is canted with respect to a line H, which line H is orthogonal to the direction V of the plane of the side surfaces of shield 11 in which opening 63 is formed. By canting the projections 64, the projections reliably enter the openings 63 without the need to tightly tolerance the locations of the projections 64 and openings 63. The canting essentially absorbs the effects of any tolerance build-ups. This is so because the canted upper and lower surfaces of the projections can engage edges of openings 63 at varying positions over a relatively wide tolerance range.

Figure 12:
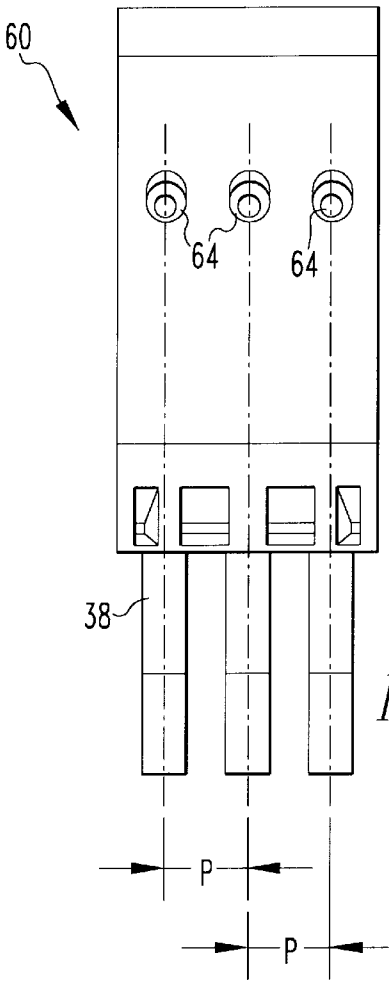
FIG. 12 is a front elevational view of the latch member shown in FIG. 11.
Figure 14:
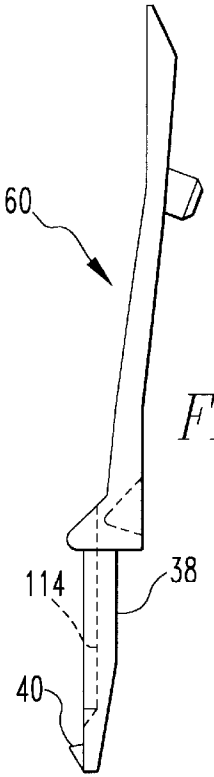
FIG. 14 is a side elevational view of the latch member shown in FIG. 11.
Figure 13:
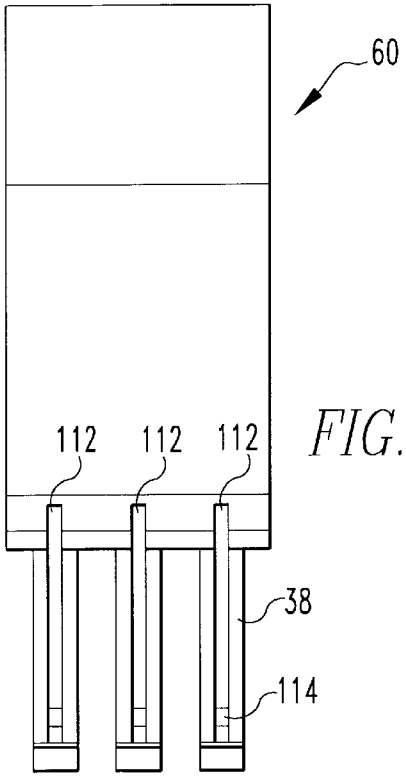
FIG. 13 is a rear elevational view of the latch member of FIG. 11.

As shown in FIG. 12, the spacing P between projections 64 is preferably equal to the grid pitch of the connector module. Hence the latch members can straddle adjacent header modules. As shown in FIGS. 13 and 14, the outside surface of each mounting leg 38 is provided with a longitudinally extending groove 114 aligned with slots 112 formed at the distal end of the latch member 60. The grooves 114 provide additional clearance and guidance for a removal tool (not shown), as previously mentioned, that is inserted from the top of the header 30, into openings 34 (FIGS. 5 and 7) as a means for removing the latch member 60 from a header.

Also, as shown the crimp ring 26' is of a hexagonal form rather than a cylindrical form of previous embodiments (FIG. 10). The hexagonal ferrule centers in the assembly tooling more readily and provides more space at the back edge of the shield for latches.

Figure 15:
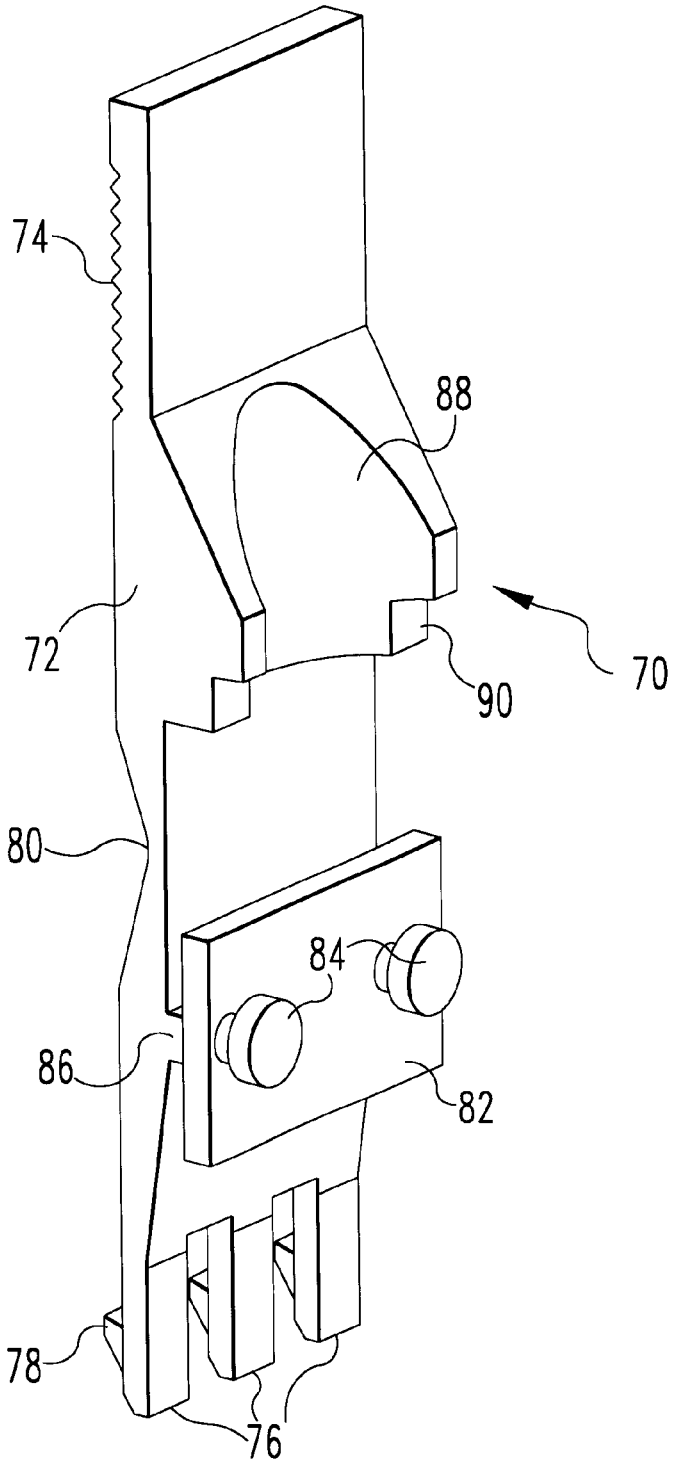
FIG. 15 illustrates another embodiment of latch member wherein the latch is mounted on the cable connector instead of the header.

FIG. 15 illustrates a latch 70 that is mounted on the cable connector, rather than on the header. In this embodiment, the latch 70 includes a body member 72 that includes at one end a finger engaging portion 74. At the other end there is disposed a plurality of latching fingers 76, each of which carries a latching projection 78. Intermediate the ends of the body 72 is a reduced thickness region 80, that is designed to facilitate bending of the body 78 along its longitudinal axis. On a reverse side, the body 72 carries a mounting plate 82 having securing lugs 84 positioned thereon. The mounting plate 82 is secured onto body 72 through "living hinge" section 86. The latch member 72 also includes a fulcrum member 88 carrying stepped surfaces 90.

Figure 16:
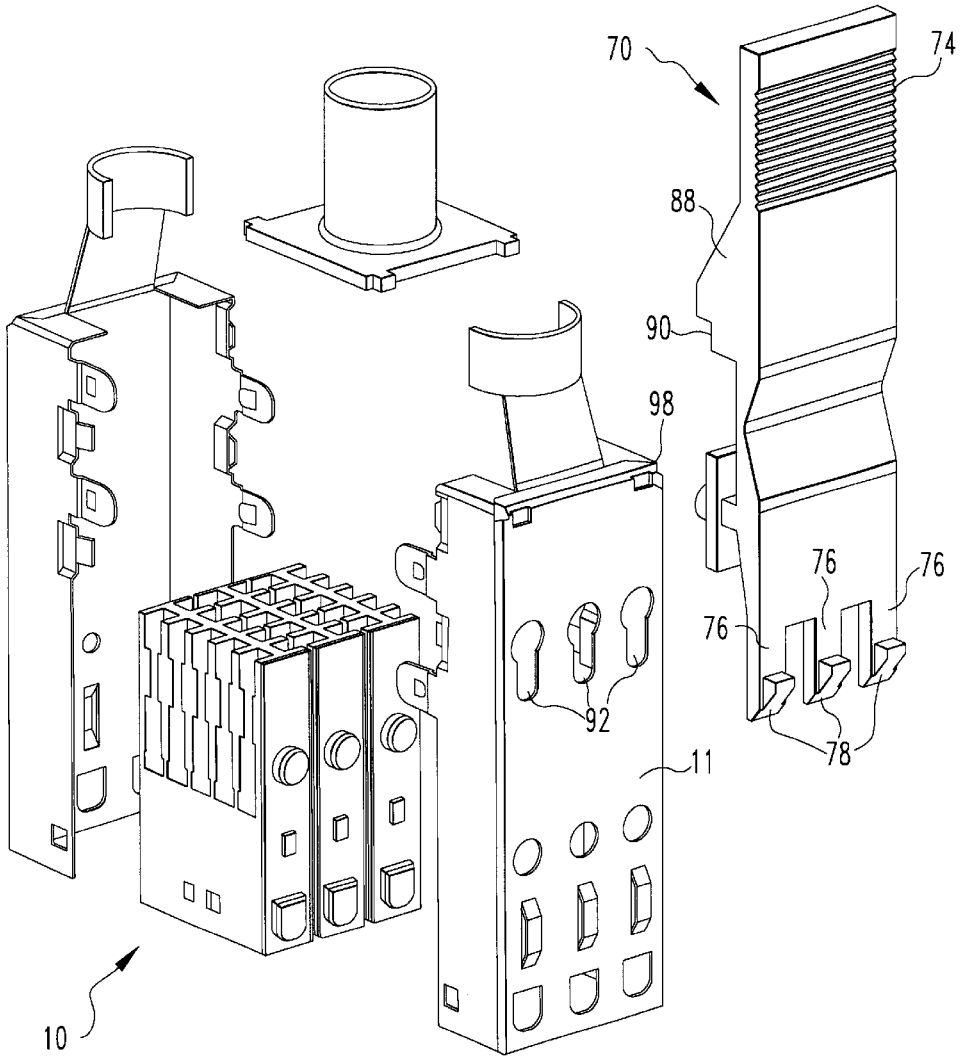
FIG. 16 is an exploded isometric view of a cable connector utilizing the latch shown in FIG. 15.

Referring to FIG. 16, a latch member 70 is secured onto a cable connector 10 by means of key ways 92 formed in one of the shields 11. By inserting the securing lugs 84 into the key ways 92, the latch 70 is retained on the cable connector.

Referring to FIG. 17, as the cable connector 10 is inserted into header 30, the fingers 76 enter into longitudinally extending openings 34 in the top of the side wall 32. The latch protrusions 78 enter into openings 96 in the side wall, and latch against the side walls of the openings 96, thereby securing the cable connector onto the header. In order to separate the cable connector from the header, a force is applied to the finger engaging portion 74 of the latch. The step 90 (FIG. 11) acts as a fulcrum against the back edge 98 of the shield 11. As a result, the latch body 72 flexes outwardly in the region of the bendable area 80. Outward flexure of the bendable area 80 results in rotation of the bottom portion of the latch member 72 about the hinge 86, thereby causing the fingers 76 to be moved inwardly, retracting the latch projections 78 from the openings 96. In this condition, the cable connector 10 is free to be withdrawn from the header 30.

Figure 18:
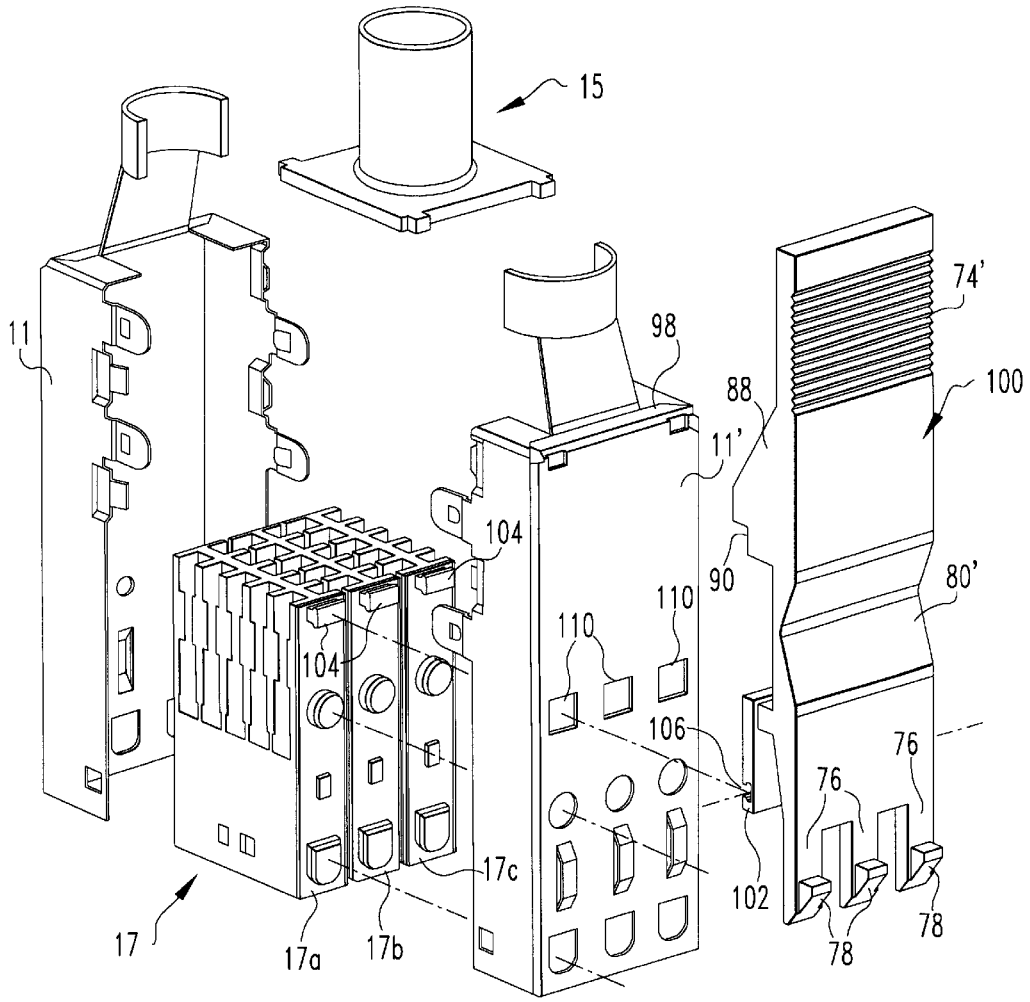
FIG. 18 is an exploded isometric view of a cable connector utilizing another latch embodiment.
Figure 19:
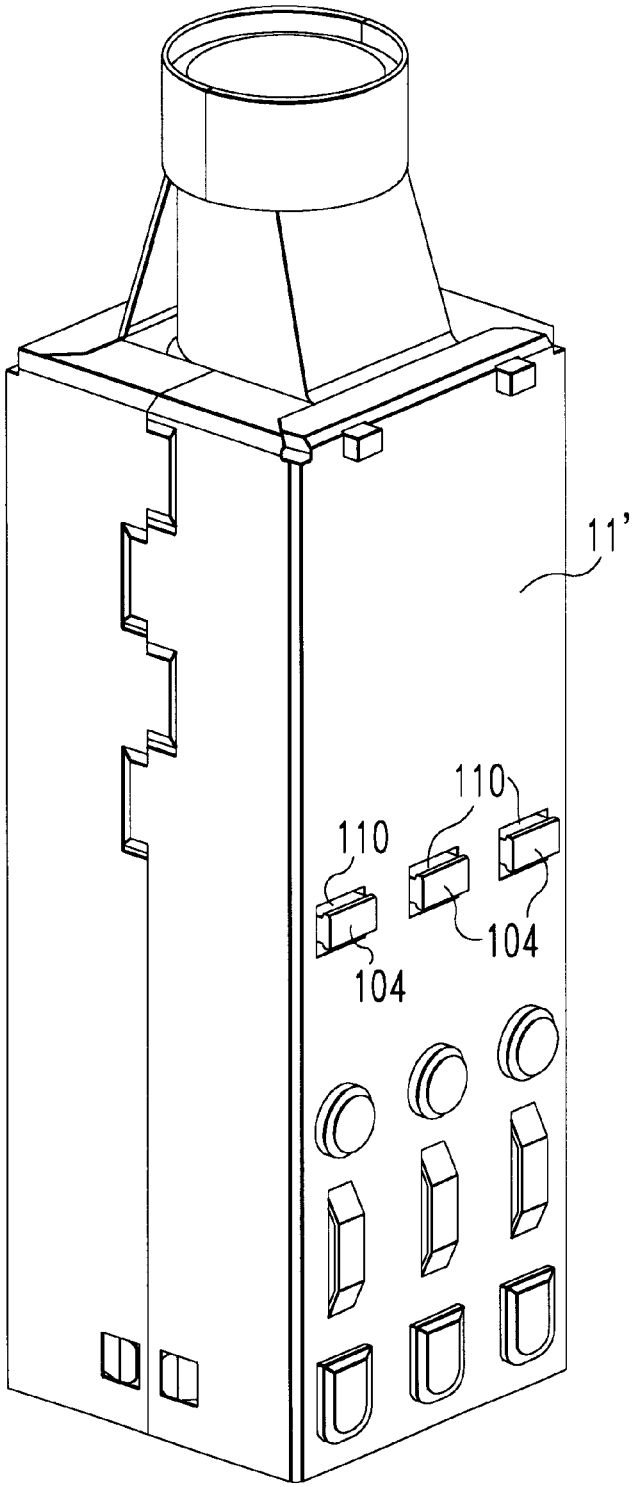
FIG. 19 is an isometric view of the cable connector of FIG. 18 in partially assembled condition, without a latch.

FIG. 18 shows another embodiment of a cable connector generally along the lines of that previously described with respect to FIGS. 15 through 17. However, in this embodiment, the latch 100 is mounted on the cable connector in a different fashion. In this embodiment, as in previous embodiments, the shields 11, 11' are placed about the terminal block 17, that can be comprised of individual modules 17*a*, 17*b* and 17*c*as previously described. The modules carry structure that extends through one of the shield halves, for example, shield 11', for mounting the latch 100 onto the connector. In the illustrated embodiment, this structure comprises generally T-shaped or dovetail mounting members 104. As illustrated in FIG. 19, the members 104 extend through openings 110 in the shield 11'.

Figure 20:
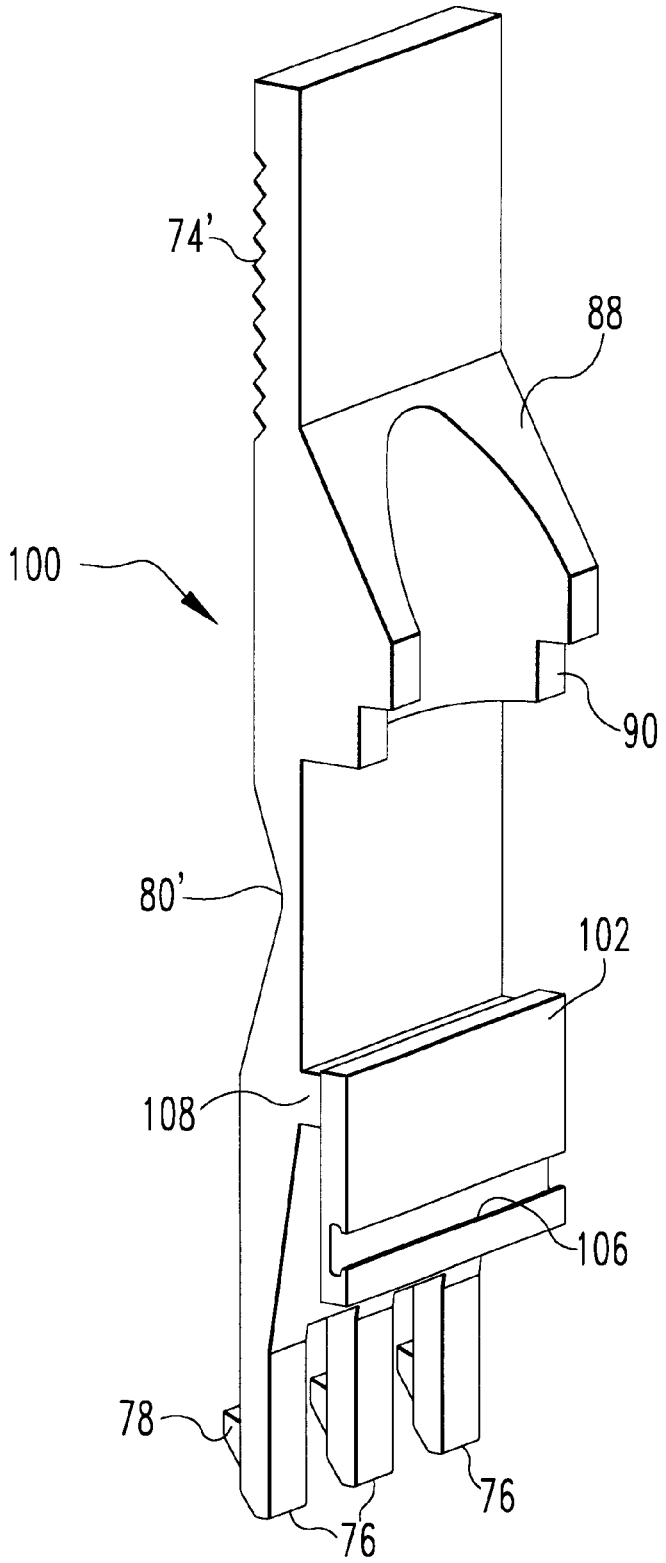
FIG. 20 is an isometric front view of a latch used with the cable connectors shown in FIGS. 15–19.

As shown in FIG. 20, the latch member 100 includes a finger engaging portion 74', a reduced thickness, bendable portion 80' and latch fingers 76 carrying latching elements 78, as previously described with reference to the FIG. 13 embodiment. The latch also includes a mounting plate 102 secured onto the latch body by a "living hinge" portion 108, also as previously described. A laterally extending dovetail groove 106 is formed on the mounting plate 102. The groove 106 is sized and shaped to be fitted over the dovetail shaped mounting members 104 by a transverse sliding movement of the plate 102 over the mounting members 104. The groove 106 and mounting members 104 are configured and sized so that there is a substantial friction fit between the members 104 and the groove 106 to retain the latch 100 in place. The latch also includes, as in previous embodiments, the fulcrum member 108 with step 90. The step 90 co-acts with the back edge of the shield 98, as previously described with respect to the embodiment of FIG. 13. The latch 100 and the latch 70 are preferably formed as a one piece molding of a thermo-plastic material. The latch 100 operates in essentially the same fashion as the latch 70, to retract the latching elements 78 of the latch fingers 76 from engagement with latching surfaces in a mating header. That is, applying a force directed toward the shield to portion 74 causes outward flexure of bendable portion 80, thereby causing the latch fingers 76 to be retracted in the direction of the shield.

Figure 21:
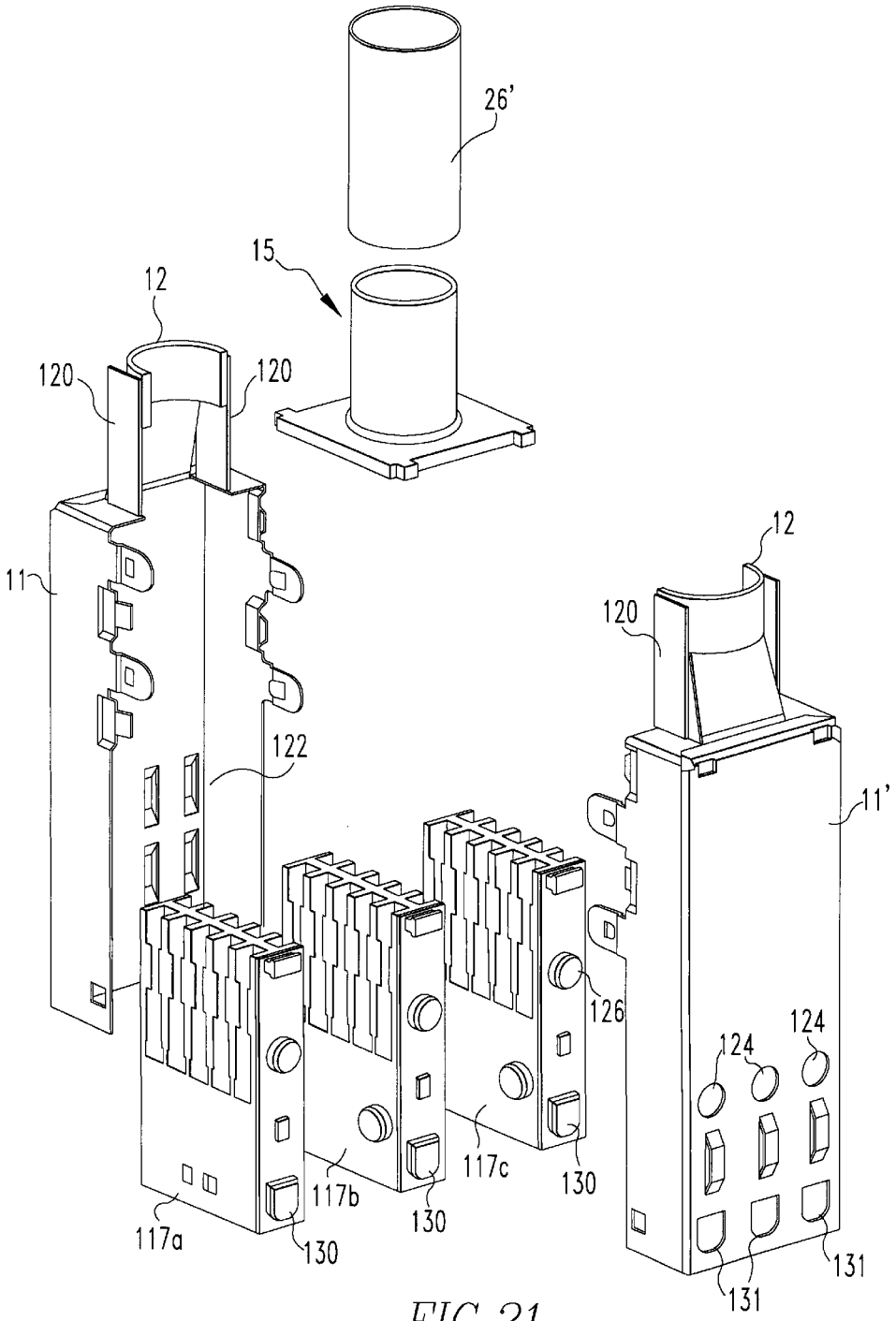
FIG. 21 is an exploded isometric view of another embodiment of shielded cable connector using a shrinkable tube as a clamp ring.

FIG. 21 shows a modified form of cable connector that comprises a plurality of terminal block modules 117*a, b* and *c*, that are joined together as in previous embodiments. In order to provide for proper assembly of the terminal modules within the shields 11 and 11', the modules have keying members 126 formed on opposite side surfaces. The keying members 126 are differently shaped on opposite sides of the terminal module to allow the terminal modules to be properly oriented in the shield halves. For example, the keying members 126 on the right hand side of the terminal modules in FIG. 21 are circular and are shaped and sized to fit closely within like shaped openings 124 in shield part 11'. Corresponding keying members (now shown) on the opposite edge of the terminal modules are another shape, for example, a rectangular shape that matches with a rectangular opening 122 in the shield part 11. In order to lessen EMI radiation from the connector, all of the elements that extend through openings in the shields, such as guidance members 130 and keying members 126 fit closely within associated openings 124, such as openings 124, 131 and 130, respectively, in the shield.

To further enhance EMI shielding, the shield parts 11, 11' shown in FIG. 21 include side shielding members 120 that form part of the strain relief structure. The members 120 are preferably formed integrally with the shields and extend upwardly to provide additional shielding at the top end of the connector. The shielding members 120 also contribute to the mechanical strength at the interface between the cable and the connector.

In this embodiment, the clamping member 26' comprises a shrinkable tubular element, for example, formed of a heat shrinkable polymer. In this arrangement, the strain relief member 15 is similar to that previously described and is associated with the shield parts 11 and 11' in the same manner. However, in this embodiment, the clamping member 26' is placed over the members 12 and 120 and then shrunk to create an inwardly directed compressive force against the strain relief member 15, thereby clamping the shield and sheath layers of the cable against the strain relief member.

Figure 22:
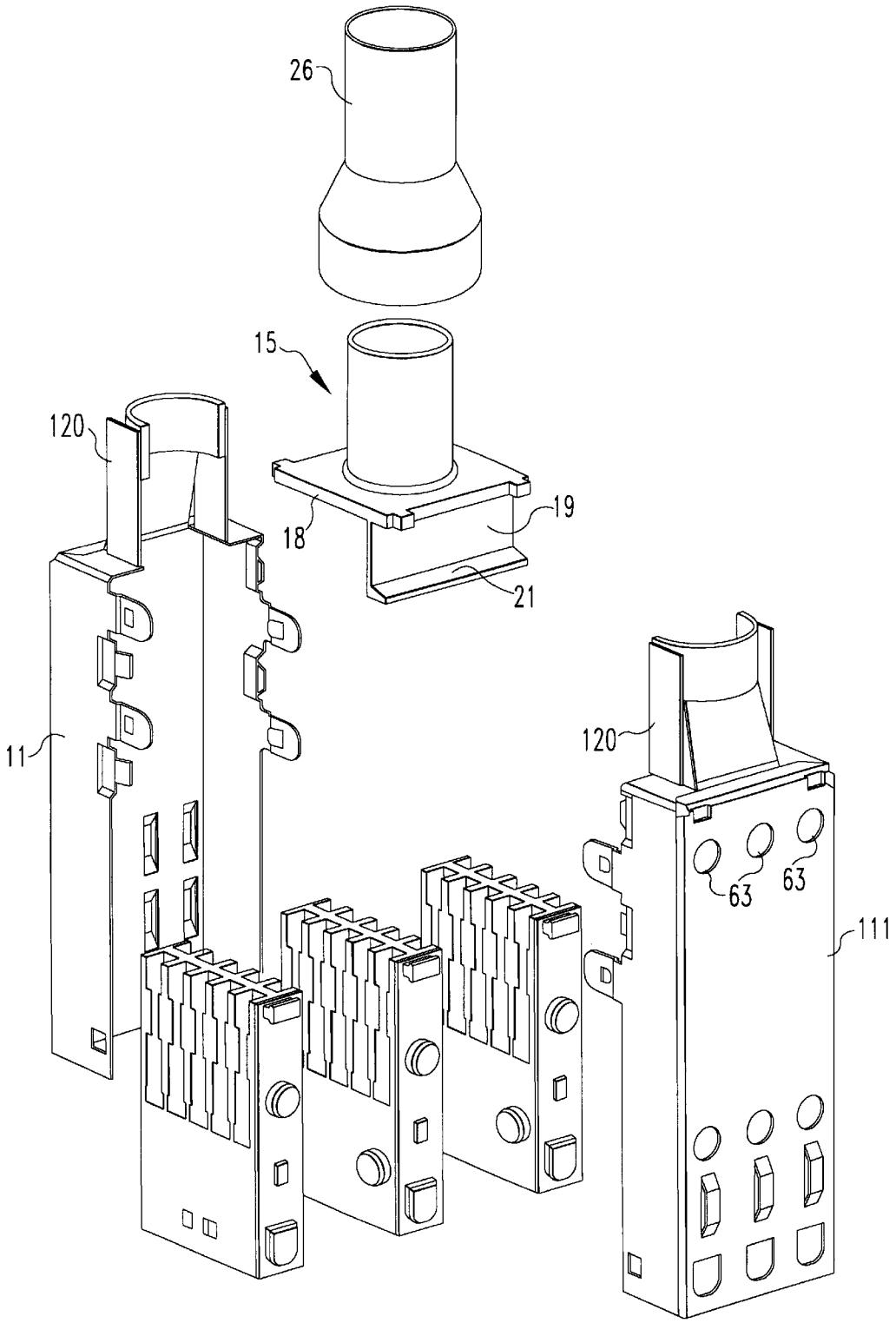
FIG. 22 is an exploded isometric view of another embodiment of cable connector.

In the embodiment of cable connector illustrated in FIG. 22, the basic parts of this connector system are similar to that previously described in connection with FIG. 21. This construction is especially useful with connection with the embodiments illustrated in FIGS. 9–14, wherein openings 63 are formed in one of the shield parts 11'. In this embodiment, the base plate 18 of the strain relief member 15 includes additional shielding structure for creating an electrical shield beneath the openings 63, to further enhance EMI shielding properties. As shown, the additional shielding structure comprise a downwardly extending wall 19 with a lip 21 formed along an edge thereof. The lip is positioned to bear against the inner surface of shield 11' below the row of holes 63. This structure provides a relief space adjacent the opening 63 to allow entrance of the projections 64, yet provides a shield around the openings 63. Preferably, the base member 18, depending shield 19 and lip 21 are formed integrally, for example, by casting.

It should be noted that the width of the latch member illustrated in all of the embodiments discussed above can be made to match the overall width of the cable connector 10. Thus, if the cable connector comprises only one of the terminal block modules the width of the latch member is made to accommodate the narrower cable connector.

The foregoing embodiments provide many product advantages. Coaxial cables tend to be somewhat stiff, especially in larger sizes. In addition, in many applications, there is very limited space for the cable to bend. These factors place strong demands on the strain relief between the connector and the cable. By providing a separate strain relief or anvil member, that can be associated with the cable prior to crimping, improved cable retention results.

Further, by providing latching that engages the strain relief structure, more secure latching results. By configuring the strain relief member to receive a portion of the insulative cover of the cable, additional improvements in the strain relief are realized. In addition, space required for the latching mechanism is minimized.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A shielded cable connector comprising:

a terminal block for receiving at least one terminal for intermating with a mating terminal;

a shield member for substantially surrounding side portions of the terminal block and having at least one aperture;

a separate strain relief member mountable on the shield member, the strain relief member comprising an end wall having an opening therein, a ferrule aligned with the opening, and a portion for electrically shielding said at least one aperture; and a clamp for clamping a portion of the cable onto the ferrule.

2. A connector as in claim 1, wherein the clamp comprises a crimp ring.

3. A connector as in claim 1, wherein the terminal block comprises a body formed of an assembly of substantially similar modules, said modules having corresponding features for holding the modules together.

4. A connector as in claim 1 wherein the shield member comprises mateable parts with corresponding latch features for securing the mateable parts together and wherein the strain relief member includes mounting structure engageable by the shield members for retaining the strain relief member on the shield member upon mating engagement of the mateable parts.

5. A connector as in claim 4, wherein the mateable parts of the shield member include cable engaging portions disposed over the ferrule and the clamp is adapted to receive the cable engaging portions and clamp said portions against the ferrule.

6. A cable connector as in claim 2, wherein the crimp ring is shrinkable.

7. A cable connector as in claim 6, wherein the crimp ring is heat shrinkable.

8. A cable assembly comprising:

a cable having a plurality of mutual insulated conductors and an electrically conducting sheath surrounding the conductors; and a connector mounted on the cable, the connector comprising:

a terminal block for receiving at least one terminal for intermating with a mating terminal and for being electrically connected to at least one of said conductors;

a shield member generally surrounding at least a portion of the terminal block and engaging said cable;

a separate strain relief member engaging said cable, a portion of the strain relief member and a portion of said shield member having an overlap; and a clamp for clamping the strain relief member and the shield member to the cable at said overlap.

9. A connector as in claim 8, wherein the clamp comprises a crimp ring.

10. A connector as in claim 8, wherein the terminal block comprises a body formed of an assembly of substantially similar modules with corresponding structure for holding the modules together.

11. A connector as in claim 8, wherein the shield member comprises mateable parts with latching structure for securing the mateable parts together and wherein the strain relief member includes mounting structure engageable by the shield members for retaining the strain relief member on the shield member upon mating engagement of the mateable parts.

12. A method for assembling a connector on a cable having a plurality of mutually insulated conductors and an electrically conductive sheath surrounding the conductors comprising the steps of:

placing a clamp member over a portion of the sheath;

engaging the cable with a strain relief member;

mounting a body on the cable to receive the conductors and electrically associate the conductors to terminals carried by the body;

applying an electrical shield member on the body to generally surround at least a portion of the body and to engage the cable; and placing the clamp over the strain relief member and the shield member; and activating the clamp to clamp the strain relief member and the shield member to the cable.

13. A method as in claim 12, wherein the cable engaging step comprises placing the strain relief member between the sheath and the insulated conductors.

14. A method according to claim 12, wherein the cable includes an outer sheath and wherein the cable engaging step comprises placing a portion of the strain relief member in underlying relationship with the outer sheath.

15. A housing for an electrical connector comprising:

a base adapted to receive electrical contacts extending in a mating direction;

a first side wall extending from the base generally in the mating direction of the contacts;

a passageway in the side wall extending from a distal end of the side wall to a proximal end of the side wall;

a first latching detent in the passageway positioned toward the distal end of the passageway; and a second latching detent in the passageway positioned toward the proximal end of the passageway;

wherein the first and second detents are formed by openings extending from a side surface of the wall into the passageway.

16. A housing as in claim 15, wherein the base is substantially planar and the side wall extends substantially orthogonally to the base along one edge thereof.

17. A housing as in claim 16, and further comprising a second side wall in opposed relation to said side wall and extending in a direction substantially parallel to said first side wall.

18. A housing for an electrical connector comprising:

a base adapted to receive electrical contacts extending in a mating direction;

a side wall extending from the base, generally in the mating direction of the contacts and having a proximal end adjacent the base and a distal end spaced from the base;

a passageway in the side wall extending generally in said mating direction;

a latch member mountable on the side wall, the latch member having a mounting portion adapted to be received in the passageway and a latching arm adapted to extend beyond the distal end of the side wall;

a locking member on the mounting portion of the latch member and a detent in the passageway for cooperating with the locking member to hold the latch member on the side wall; and a release space associated with the passageway for allowing passage of a release member for releasing the locking member from the detent.

19. A housing as in claim 18, wherein the release space comprises an opening extending from a side surface of the side wall to the passageway.

20. A housing as in claim 19, wherein the detent is located at an intersection of the release space with the passageway.

21. A housing as in claim 18, wherein the release space is adapted to receive a portion of the latch member to effect release of the locking member from the detent.

22. A housing as in claim 18, wherein the release space is adapted to receive at least a part of the mounting portion of the latch member.

23. A housing as in claim 22, wherein the release space comprises an opening in the side wall extending to the passageway.

24. A housing as in claim 18, wherein the release space includes an opening on an upper surface of the side wall, whereby a tool can be inserted into the release space from said upper surface, to effect removal of the latch member.

25. An electrical cable interconnection comprising:

a first connector;

a cable connector adapted to mate with the first connector;

a releasable latch member mounted on the first connector for holding the cable connector in mating relationship with the first connector, the latch member being positioned in facing relationship to a side surface of the cable connector;

a latch structure comprising at least two spaced protrusions formed on a portion of the latch member facing said side surface of the cable connector and at least two spaced openings in said side surface of cable connector positioned for receiving the protrusion when the connectors are mated.

26. An interconnection as in claim 25, wherein the longitudinal axis of the projection is canted with respect to a plane in which said opening is formed.

27. An interconnection as in claim 25, wherein the projection has a canted surface for engaging an edge of said opening.

28. A cable connector, comprising:

a housing for receiving at least one terminal to engage a mating terminal;

a shield defining an enclosure generally surrounding at least a portion said housing and including;

an aperture for entry of the cable into said enclosure; and a plurality of projections extending along the cable and away from said enclosure, wherein one of said projections is arranged transversely to another of said projections; and a clamp for securing said plurality of projections to the cable externally of said enclosure.

29. The cable connector as recited in claim 28, further comprising a separate member secured to the cable by said clamp for providing strain relief.

30. The cable connector as recited in claim 28, wherein the clamp is a shrinkable material.

31. The cable connector as recited in claim 30, wherein said shrinkable material is a heat shrinkable material.

32. The cable connector as recited in claim 28, wherein one of said projections has at least a portion that is generally conforming to a shape of the cable and another of said projections is generally planar.

33. A cable connector, comprising:

a housing for receiving at least one terminal to engage a mating terminal;

a two-piece shield generally surrounding at least a portion of said housing, each shield piece having at least one projection generally conforming to a shape of the cable and two generally planar projections flanking said conforming projection;

a separate strain relief member; and a clamp for securing said plurality of projections and said strain relief to the cable.

34. The cable connector as recited in claim 33, wherein one of said projections is generally transverse to another of said projections.

35. A cable connector, comprising:

a housing for receiving at least one terminal to engage a mating terminal;

a shield generally surrounding at least a portion of said housing;

a separate strain relief member, having:

a first portion extending from said shield;

a wall within said shield and extending towards said housing; and a plate between said first portion and said wall, said plate transverse to said wall; and a clamp for securing said first portion of said shield and said strain relief to the cable.

36. The cable connector as recited in claim 35, wherein said plate includes an opening therein, said first portion being a ferrule in communication with said opening.

37. The cable connector as recited in claim 35, wherein said second portion further comprising a lip extending from said wall.

38. The cable connector as recited in claim 37, wherein said second portion and said shield form an enclosure.

39. The cable connector as recited in claim 38, wherein said shield includes an opening therein in communication with said enclosure.

40. The cable connector as recited in claim 1, wherein said portion comprises a wall having a lip extending therefrom.

41. The connector as recited in claim 8, wherein said shield member and said strain relief member engage said sheath.

42. The method as recited in claim 12, further comprising the step of overlapping said shield member and said strain relief member.

43. A connector as in claim 41, wherein the shield member engages one of an inner and outer surface of said sheath and the strain relief member engages the other one of said inner and outer surfaces.

44. A shielded cable connector comprising:

a terminal block for receiving at least one terminal for intermating with a mating terminal;

a shield member for substantially surrounding side portions of the terminal block;

a separate strain relief member mountable on the shield member, the strain relief member comprising an end wall having an opening therein and a ferrule aligned with the opening and having at least a portion extending away from the terminal block; and a clamp for clamping a portion of the cable onto the portion of the ferrule extending away from the terminal block.

45. A connector as in claim 44, wherein the clamp comprises a crimp ring.

46. A connector as in claim 44, wherein the terminal block comprises a body formed of an assembly of substantially similar modules each with corresponding structure for holding the modules together.

47. A connector as in claim 46, wherein the structure on one of the modules comprises a projection.

48. A connector as in claim 44 wherein the shield member comprises mateable parts with corresponding structure for securing the mateable parts together and wherein the strain relief member includes structure engageable by the shield members for retaining the strain relief member on the shield member upon mating engagement of the mateable parts.

49. A connector as in claim 48, wherein the mateable parts of the shield member include cable engaging portions disposed over the ferrule and the clamp is adapted to receive the cable engaging portions and clamp said portions against the ferrule.

50. A connector as in claim 48, wherein the structure on one mateable part comprises a latch member and the structure on another mateable part comprises a latch structure adapted to engage the latch member.

51. A connector as in claim 48, wherein the structure of the strain relief member comprises a lug.

52. A connector as in claim 44, in combination with a cable, comprising:

a plurality of insulated conductors; and an electrically conducting sheath surrounding the insulative conductors;

wherein the terminal block electrically connects to at least one of the insulated conductors, the opening in the strain relief member receives the insulative conductors, and the ferrule receives the conducting sheath.

53. A method for assembling a connector on a cable having a plurality of mutually insulated conductors and an electrically conductive sheath surrounding the conductors comprising the steps of:

placing a clamp member over a portion of the sheath;

positioning a strain relief member having a ferrule over the conductors and in a position to receive the sheath on an outer surface of the ferrule;

mounting a body on the cable to receive the conductors and electrically associate the conductors to terminals carried by the body;

applying a electrical shield member on the body to substantially surround the body and engage with the strain relief member; and placing the clamp over the ferrule; and activating the clamp to clamp the sheath on the ferrule;

wherein the clamp activating step occurs subsequent to the electrical shield member applying step.

54. A method as in claim 53, and further comprising the step of placing cable engaging portions of the shield members over the sheath, whereby the clamp clamps the sheath and the cable engaging portions of the shield member on the ferrule.

55. A method according to claim 53, wherein the cable includes an outer sheath and wherein the step of positioning the strain relief member includes placing a portion of the ferrule in underlying relationship with the outer sheath.

56. A cable interconnection comprising:

a header connector for mounting on a circuit substrate, the header connector including a latch member extending therefrom; and a cable connector having a mating end intermateable with the header connector and a cable end for receiving a cable, the cable connector having a cable strain relief member associated therewith at the cable receiving ends and a shield member for providing electrical shielding;

wherein the cable strain relief member includes a latching portion having a mounting lug for mounting the strain relief member on the shield member, and the latch member includes a surface engaging said latching portion.

57. An interconnection as in claim 56, wherein the latch member includes an opening for receiving the lug, whereby the cable connector is secured to the header connector.

58. An interconnection as in claim 56, wherein the surface of the latch portion engaged by the latch member faces away from the header connector.

59. A cable connector comprising:

a terminal block for receiving at least one terminal for intermating with a mating terminal;

a shield member surrounding at least a portion of the terminal block and having at least one opening; and a latch member overlying the shield and having a projection extending into the opening in the shield member for mounting to the shield.

60. A cable connector as in claim 59, wherein the latch member includes a first structure defining a fulcrum for coacting with a portion of the shield.

61. A cable connector as in claim 60, wherein the latch includes a second structure defining a fulcrum.

62. A cable connector as in claim 61, wherein the latch member is elongated and has a first end adapted to receive an unlatching force, a second end opposed to the first end, a latching element disposed at the second end, and the first and second fulcrum structures are intermediate the first and second ends, whereby movement of the first end toward the shield effects movement of the latching member toward the shield.

63. A cable connector comprising:

a terminal block for receiving at least one terminal for intermating with a mating terminal;

a shield member surrounding at least a portion of the terminal block; and a latch member overlying the shield and comprising at least one member for mounting the latch member on the terminal block.

64. A cable connector as in claim 63, wherein the shield member includes an opening, the terminal block includes a projection extending through the opening, and the latch member secures to the projection.

65. A cable connector as in claim 63, wherein the latch member includes a first structure defining a fulcrum for coacting with a portion of the shield.

66. A cable connector as in claim 65, wherein the latch includes a second structure defining a fulcrum.

67. A cable connector as in claim 66, wherein the latch member is elongated and has a first end adapted to receive an unlatching force, a second end opposed to the first end, a latching element disposed at the second end, and the first and second fulcrum structures are intermediate the first and second ends, whereby movement of the first end toward the shield effects movement of the latching member toward the shield.

* * * * *